US006796915B2

(12) United States Patent
Getchell

(10) Patent No.: US 6,796,915 B2
(45) Date of Patent: Sep. 28, 2004

(54) HOCKEY CHECKING PRACTICE DUMMY

(76) Inventor: Michael S. Getchell, 103 Cranberry Dr., Halifax, MA (US) 02338

( * ) Notice: Subject to any disclaimer, the term of this patent is extended or adjusted under 35 U.S.C. 154(b) by 0 days.

(21) Appl. No.: 10/244,581

(22) Filed: Sep. 16, 2002

(65) Prior Publication Data

US 2003/0054904 A1 Mar. 20, 2003

Related U.S. Application Data

(60) Provisional application No. 60/322,787, filed on Sep. 17, 2001.

(51) Int. Cl.[7] ..... A63B 63/00

(52) U.S. Cl. ..... 473/446; 473/438

(58) Field of Search ..... 473/446, 447, 473/448, 444, 438, 445, 442, 441, 422, 439, 443; 434/256, 247, 251, 545; 482/83, 89; 280/293; 446/369, 226, 273, 325, 220; D20/31, 25; 15/159.1

(56) References Cited

U.S. PATENT DOCUMENTS 2,904,337 A * 9/1959 Canning ..... 473/444
3,614,149 A * 10/1971 Clark ..... 294/19.2
3,831,941 A * 8/1974 Pease ..... 267/116
3,889,948 A * 6/1975 Visco ..... 473/441
4,489,940 A * 12/1984 Amundson ..... 473/446
5,527,185 A * 6/1996 Davis ..... 473/438
5,624,358 A * 4/1997 Hestilow ..... 482/90
5,984,809 A * 11/1999 Hadar et al. ..... 473/444
6,012,994 A * 1/2000 Beluse ..... 473/446
D422,825 S * 4/2000 Hoffmann ..... D6/552
6,183,399 B1 * 2/2001 Chen ..... 482/90

* cited by examiner

*Primary Examiner*—Gregory Vidovich
*Assistant Examiner*—M. Chambers
(74) *Attorney, Agent, or Firm*—Altman & Martin

(57) ABSTRACT

A dummy for practicing hockey checking composed of a base, an upper body, and a mechanism for controlling the dummy's motion. The generally cylindrical base has a foundation, an upwardly-extending column, and is weighted. The weight can be a solid weight or a removable material, such as sand or water, in a hollow container in the base. The upper body core is a column that slides onto or into the base column. A torso and a head is composed of a hard but resilient material. Rolled foam arms optionally have bendable wires for retaining the arms in a desired position. The upper body is covered with standard hockey clothing and equipment and a stick is secured to the gloves. The height of the dummy is adjustably by sliding and locking the base and upper body columns relative to each other. The undersurface of the base is smooth or has wheels or knobs in order to easily slide along the playing surface. A control grip controls motion of the dummy, and include a pair of hand loops attached to the back of the upper body, a rigid bar pivotally mounted to the back of the upper body, or an elongated rod connected to the base by a ball and socket joint.

27 Claims, 5 Drawing Sheets

HOCKEY CHECKING PRACTICE DUMMY

CROSS-REFERENCES TO RELATED APPLICATIONS

The applicant wishes to claim the benefit of U.S. Provisional Patent Application No. 60/322,787, dated Sep. 17, 2001 for HOCKEY CHECKING PADDED DUMMIE in the name of Michael S. Getchell.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to hockey equipment, more particularly, to a dummy for practicing checking.

2. Description of the Related Art

In hockey, checking is a defensive skill that takes several different forms. In body checking, a player uses shoulders, chest, or hips to make contact with an opposing player to take that player out of the play or against a puck-carrier in such a way that the puck-carrier can no longer control the puck. In stick- or poke-checking, a player uses his stick to poke the puck off an opponent's stick. Checking is a basic defensive skill of the game, and requires practice to become proficient.

Without use of the present invention, a player is first shown and told how to hold his head, hands, and stick, and where to position his legs when preparing to make a body check. The technique is demonstrated slowly on another player. Then practice takes place between two players. Typically, the player being checked has to be told to allow the checking player to finish the check. If this practice is performed at full speed, most players never finish the check.

The one-on-one drill is used to show defensemen how to hip check and do a turnout check. The offensive player skates forward toward the defensive player who is skating backwards. The defensive player is supposed to hip check and turn out the offensive player into the boards with the check. However, in most cases, the offensive player is faster and the defensive player never gets to make contact with him.

There is a present need for an apparatus that allows a player to practice checking in which the check can be completed by the player at full speed.

BRIEF SUMMARY OF THE INVENTION

An object of the present invention is to provide a dummy that can be used to practice hockey checking that is superior in ways to player-on-player practice checking.

Another object is to provide a hockey checking practice dummy that can be controlled by another person to react as a live player would while directing the practice session.

A further object is to provide a hockey checking practice dummy that allows a player to practice checking at full speed.

A further object is to provide a hockey checking practice dummy that emulates the feel of checking so that the practice is relatively close to checking a live person.

The present invention is a dummy for practicing hockey checking, and is composed of a base, an upper body, and a mechanism for controlling motion of the dummy. The generally cylindrical base has a rigid foundation and an upwardly-extending, rigid column. The column is a hollow or solid cylinder onto which the upper body is secured. The base is weighted, in part to emulate the weight of a human being and in part to prevent the dummy from tipping. The weight can be a solid weight as a component of the base or, preferably, a material in a hollow container in the base. Optionally, the material in poured into the container through a cap and can be removed the same way. Preferably, the outer surface of the foundation is padded. Optionally, the base includes a puck holder for practicing poke-checking.

The upper body has a life-like appearance and feel. At its core is a column that slides onto or into the base column. The current design has the base column as a post and the upper body column as a sleeve, but the reverse is also contemplated. The column is attached to a torso on top of which is a head, preferably composed of a hard but resilient material. The arms are constructed of rolled soft foam, wherein the sleeves of the jersey provide a covering to retain the rolled shape. Optionally, the arms have bendable wires in order to provide a means for retaining the arms in a desired position. The upper body is covered with standard hockey clothing and equipment, including shoulder pads, jersey, helmet, and gloves. A stick is secured to the gloves. The lower section of the upper body is padded.

The height of the dummy is adjustable by any of the many methods known in the art. One method includes providing the base column post with shaped depressions and the upper body column sleeve with protrusions. The depressions have a plurality of stops at different heights on which the protrusions can rest. Alternatively, a spring-loaded rod fits into depressions in the post. Adjusting the height is matter of pulling the rod out, changing the height of the upper body, and releasing the rod so the spring pulls it into a different depression. Alternatively, the spring-loaded rod is replaced by a large set screw.

Several methods are contemplated for making the dummy slideable across the playing surface. One method is to make the undersurface of the foundation smooth enough to slide easily and, optionally, coat it with a non-stick material. In another method, feet, in the form of either wheels or knobs, are attached to the underside of the foundation. The knobs can be composed of or coated with a non-slip material.

A control grip allows a coach to control the motion of the dummy before and after being hit. Examples of the control include a pair of hand loops attached to the back of the upper body, a rigid bar pivotally mounted to the back of the upper body, and an elongated rod connected to the base by a ball and socket joint.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

The present invention is a dummy for practicing hockey checking. The present invention is concerned with both ice hockey and roller hockey, although the present invention contemplates that the dummy disclosed herein may be used in practicing other sports where checking or the equivalent is a necessary skill. Since ice hockey is more prevalent than roller hockey, the present specification uses terms associated with ice hockey when appropriate and the roller hockey equivalents are presumed.

Figure 1:
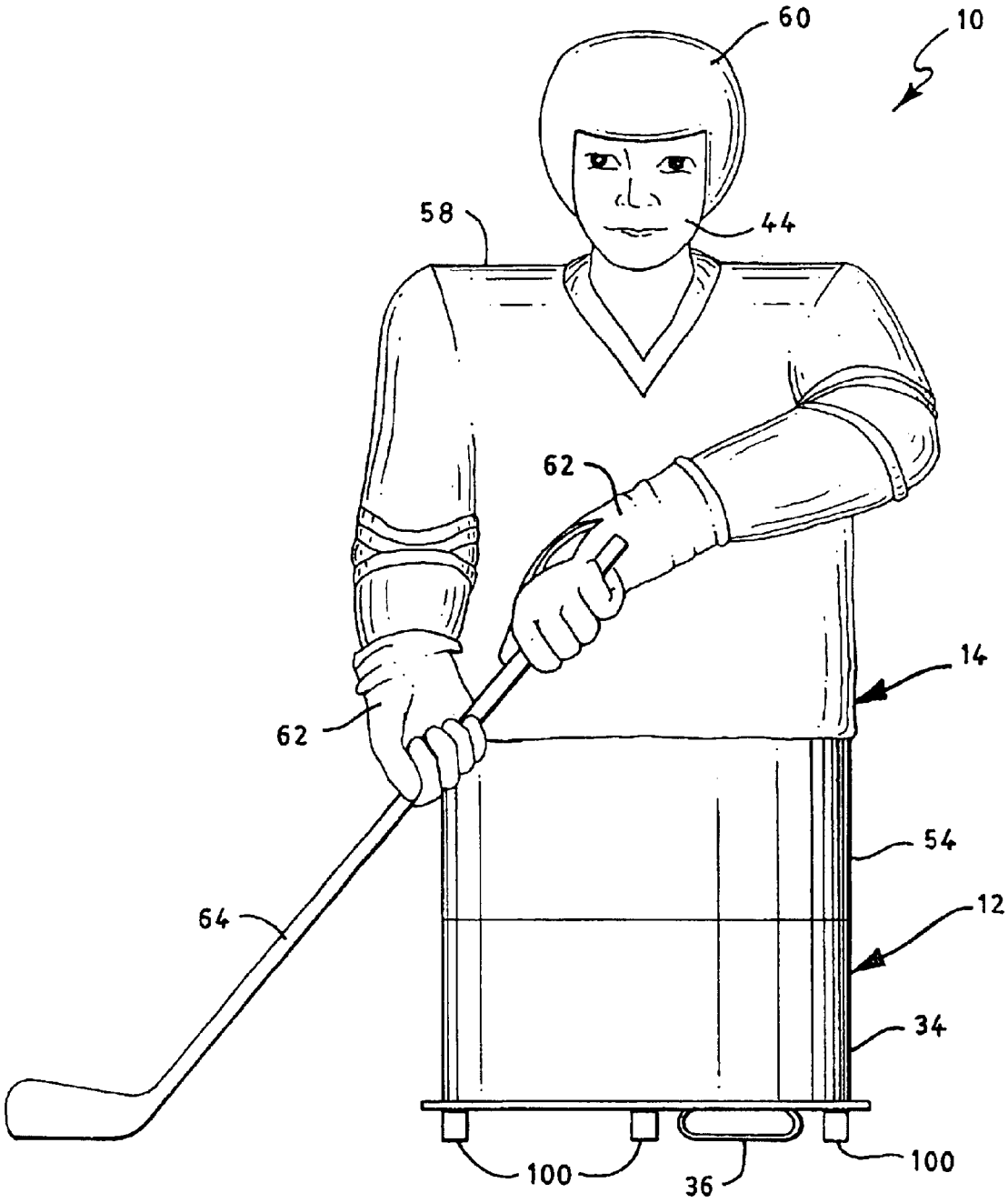
FIG. 1 is a front view of the check practice dummy of the present invention.

The dummy 10 of the present invention, shown in FIG. 1, is composed of two separable components, the base 12 and the upper body 14. The dummy 10 also includes a mechanism for controlling the motion of the dummy 10 while in use.

Figure 2:
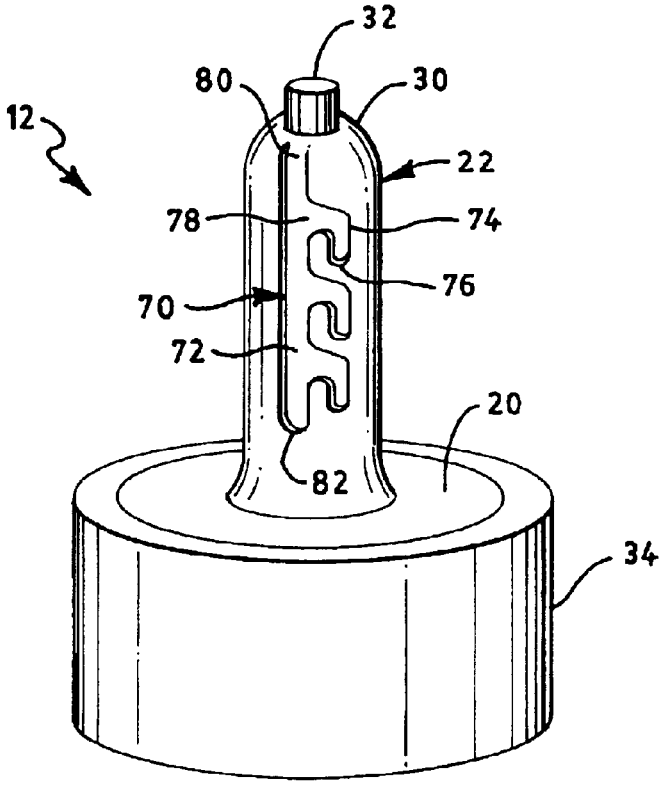
FIG. 2 is a perspective view of the base of the dummy of FIG. 1.

The base 12, an embodiment of which is shown in FIG. 2, is generally cylindrical and includes a rigid foundation 20 and an upwardly-extending, rigid column 22. The foundation 20 may be a rigid sheet, for example, wood or plastic, from which the post 22 extends. Alternatively, the foundation 20 may be a barrel-shaped container, as described below. The column 22 is a hollow or solid cylinder onto which the upper body 14 is secured.

Figure 3:
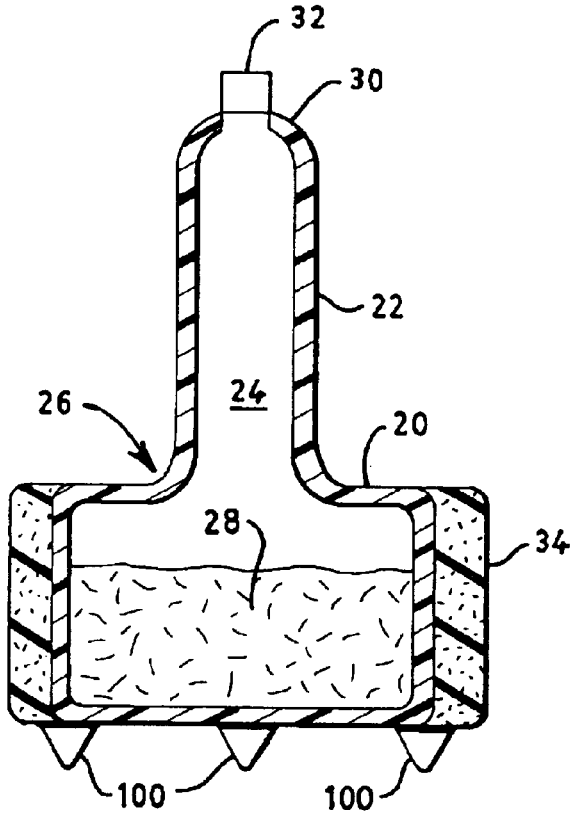
FIG. 3 is a cross-section view of the base of FIG. 2.

One object of the present invention is to emulate a human being, one characteristic of which is weight, and the present invention contemplates several ways to emulate the weight of a human being. One method is to provide a solid weight as a component of the base 12, for example, lead weights or concrete fill. The preferred method is to provide a hollow container in the base 12 that can be filled with a weighting material, for example, water or sand. In the present embodiment, as shown in FIG. 3, the foundation 20 and column 22 are an integral hollow unit 26. The hollow interior of the foundation/column provides the container 24 in which the weighting material 28 resides. The container 24 may be sealed, that is, the weighting material 28 is installed during manufacture and is inaccessible to the user. Alternatively, and more preferably, there is a removable cap 32 at the top end 30 of the column 22 into which the weighting material 28 can be poured. When needed, the weighting material 28 can be poured out to more easily transport the dummy 10. In addition, the weight of the dummy can be adjusted for a particular usage by using more or less weighting material 28. Finally, the weight also helps to prevent the dummy 10 from tipping over.

Preferably, the hard, outer surfaces, in particular, the outer surface of the foundation 20, are padded, as at 34, in order to protect any player hitting the dummy 10. The padding 34 is preferably a covered foam material, but air-inflated pads and other foam equivalents are also contemplated.

Optionally, the base 12 has a puck holder 36 for practicing poke-checking. Any configuration that holds the puck on the ice can be used. The puck holder 36 should be able to retain the puck while the dummy 10 is moving around, but that will release the puck when the puck is hit by a sufficient amount of force such as, for example, if properly struck with a hockey stick. In one configuration, the puck holder 36 is a low-rim round cup attached to the foundation 20 at the playing surface. A puck is placed on the cup prior to a practice check. Optionally, the foundation 20 houses a puck dispenser. As the puck is poked from the puck holder, a new puck is dispensed to the cup.

The other component of the dummy 10 of the present invention is the upper body 14. The object of the construction of the upper body 14 is as life-like an appearance and feel as is practical. The core of the upper body 14 is a column 40 that slides onto or into the base column 22. One column 22, 40 is a post (male) while the other column is a sleeve (female). The current design of the dummy 10 of the present invention has the base column 22 as a post and the upper body column 40 as a sleeve. The remainder of the present specification assumes this configuration. However, the present invention contemplates that the base column 22 may be a sleeve and the upper body column 40 may be a post. The upper body column 40 (sleeve) can slide far enough down the base column 22 (post) that the desired overall height of the dummy 10 is achieved.

Figure 4:
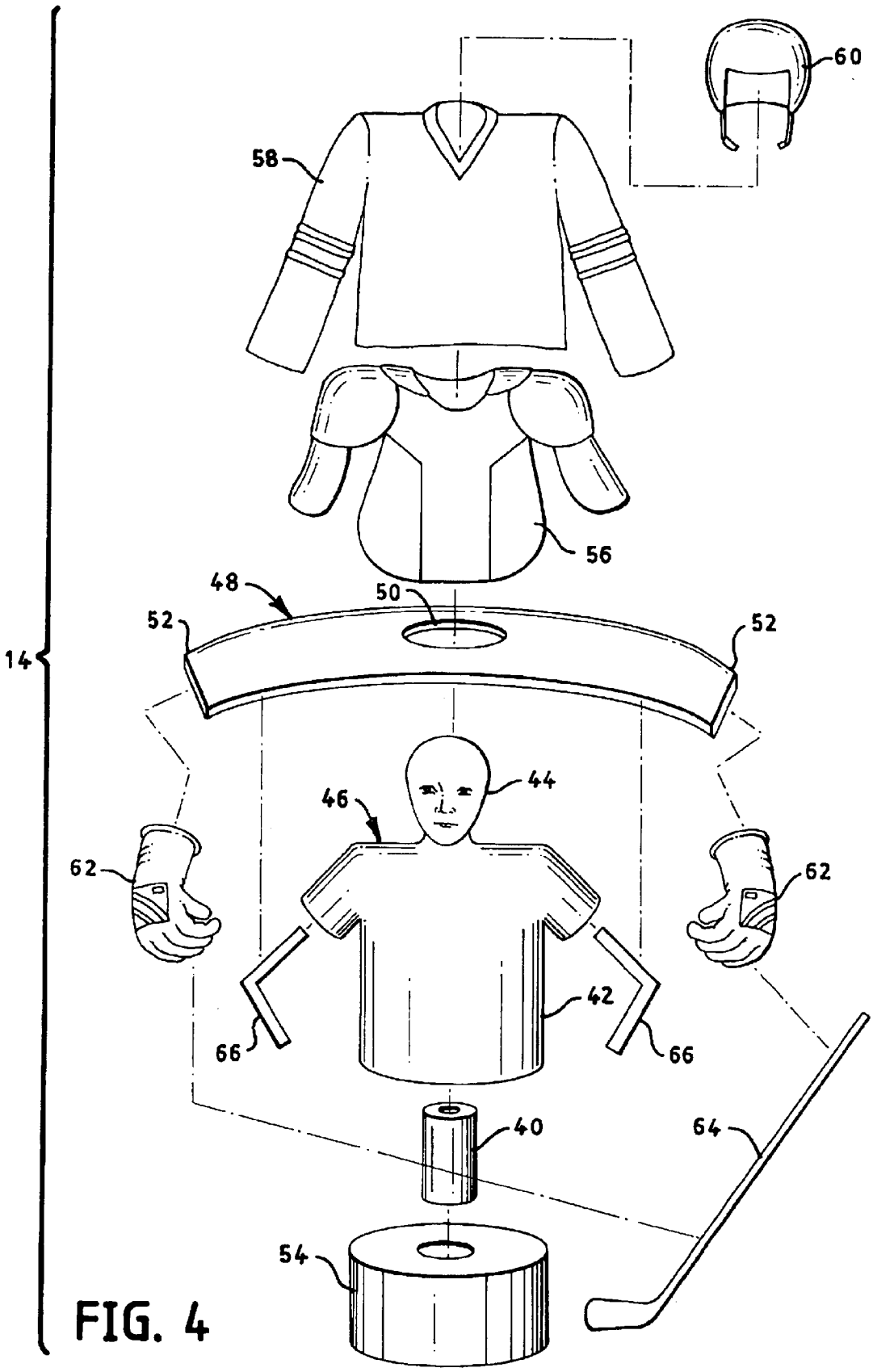
FIG. 4 is an exploded view of the upper body of FIG. 1.

Around the upper body column 40 is a torso 42 on top of which is a head 44. The torso/head are preferably composed of a hard but resilient material, such as a soft foam inner layer with a hard foam or rubber outer layer. For simplicity in construction, the present embodiment employs a pre-manufactured torso/head combination 46, which provides life-like features, proportions, and appearance. The arms are constructed of rolled soft foam 48 and attached to the torso 42 by placing the head 44 through a hole 50 in the foam 48, as in FIG. 4. The outer sections 52 of the foam 48 are rolled to form the arms, and the sleeves of the jersey 58 provide a covering to retain the rolled shape. Optionally, elbow pads are placed at the location of elbows. Optionally, bendable wires or rods 66 are attached to the torso 42 and extended through the rolled foam in order to provide a means for retaining the arms in a desired position.

The lower section of the upper body column 40 is covered in padding 54 to a depth enough to simulate the stomach/waist section of the body. As with the base padding 34, the upper body padding 54 may be a covered foam material, air-inflated pads, or equivalents.

The torso/head 46 is covered with standard hockey clothing and equipment, including shoulder pads 56, jersey 58, and helmet 60. Gloves 62 are secured to the ends of the arms 48 and a stick 64 is secured to the gloves 62. Optionally, the arms 48 are constructed so that the dummy 10 can be configured as right handed or left handed. In such a case, the attachment of the stick 64 to the gloves 62 is removable by using, for example, microhook connectors such as VELCRO brand microhook connectors.

Figure 5:
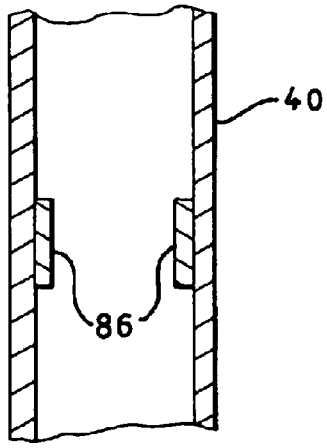
FIG. 5 is a cross-sectional view of the upper body cylinder.

Optionally, the height of the dummy 10 is adjustable. The present invention contemplates that any of the many methods known in the art of providing an adjustable height may be employed. The components of a preferred method are shown in FIGS. 2 and 5, assuming that the base column 22 is a post and the upper body column 40 is a sleeve. The outer surface of the base column 22 is provided with one or more shaped depressions 70, as shown in FIG. 2. The depression 70 has a vertical spine 72 with one or more branches 74 having an end 76 lower than the branch's junction 78 to the spine 72. The upper end 80 of the spine 70 opens at the top 30 of the post 22. As shown in FIG. 5, the inner surface of the upper body column 40 has a number of protrusions 86 equal to the number of depressions 70. In order to lower the upper body 14 onto the base column 22, the protrusions 86 must be aligned with the spine upper ends 80. For the shortest height, the protrusions 86 rest on the bottom ends 82 of the spines 72. For other heights, the upper body 14 is raised or lowered until the protrusions 86 align with the appropriate junctions 78 and then the upper body 14 is twisted and dropped until the protrusions 86 rest on the branch ends 76.

Figure 6:
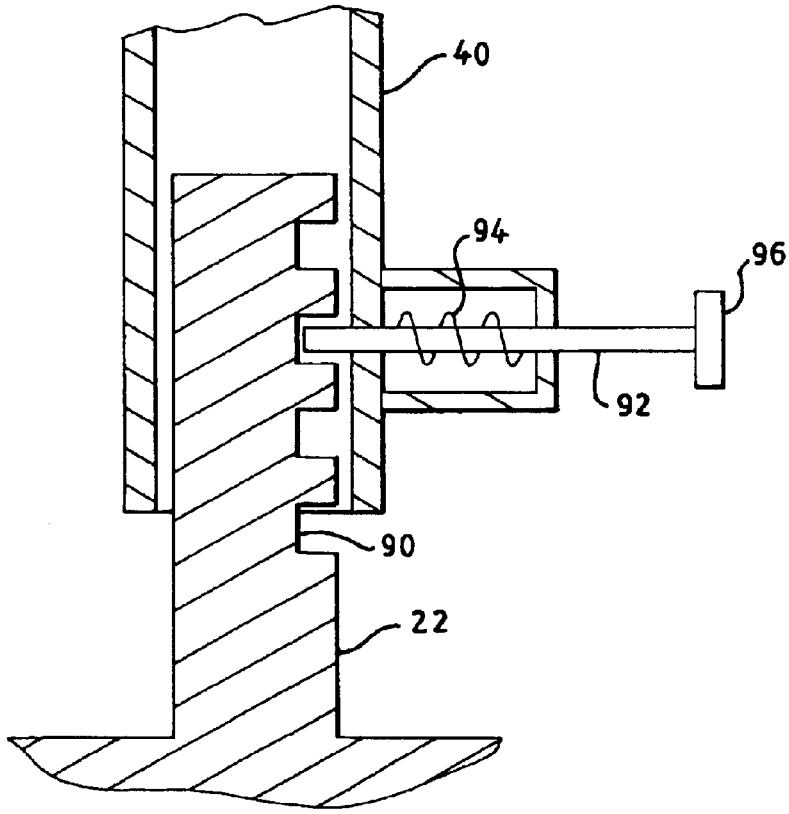
FIG. 6 is a cross-sectional view of an alternate height adjustment mechanism.

Another method for providing an adjustable height is shown in FIG. 6 and includes a plurality of discrete depressions 90 in the base column 22 and a rod 92 extending radially into the upper body column 40 and into one of the depressions 90. A spring 94 biases the rod 92 into the depression 90. A handle 96 permits the user to pull the rod 92 from the depression 90 while raising or lowering the upper body 14 to align the rod 92 with another depression 90. When the handle 96 is released, the spring 94 biases the rod 92 into the new depression 90, causing the upper body 14 to be retained at the new height. Alternatively, the rod/spring component is replaced by a set screw.

As indicated above, the present invention contemplates that the base column 22 is a sleeve and the upper body column 40 is a post. All the same adjustment mechanisms described above can be employed.

A characteristic of the dummy 10 of the present invention is that it can be manually moved about as desired by a coach in response to being hit. There are two aspects to this mobility: the ability to easily move on the playing surface and a method of manually controlling such movement. The ability to easily move on the playing surface is accomplished in one of two ways. In the first, the undersurface of the foundation 20 is smooth enough to slide easily on the playing surface, particularly ice. Optionally, the undersurface of the foundation 20 is coated with a non-stick material, such as Teflon. Alternatively, feet 100 are attached to the underside of the foundation 20 and support the dummy 10 on the playing surface. In order to facilitate easy motion of the dummy 10, the feet 100 must slide or otherwise move easily on the playing surface. Two basic types of feet 100 are contemplated by the present invention: knobs and wheels. Knobs are short protrusions from the underside of the foundation 20 that have rounded ends so that they glide on the ice playing surface, rather than gouge or dig into the ice. If desired, the knobs can be composed of or coated with a non-slip material, such as Teflon. Wheels are necessary when the dummy 10 is to be used on pavement, but work quite well on ice also. The preferred wheels are ball bearing that are encased such that they can spin in any direction. Such wheels are well-known in the art.

Figure 7:
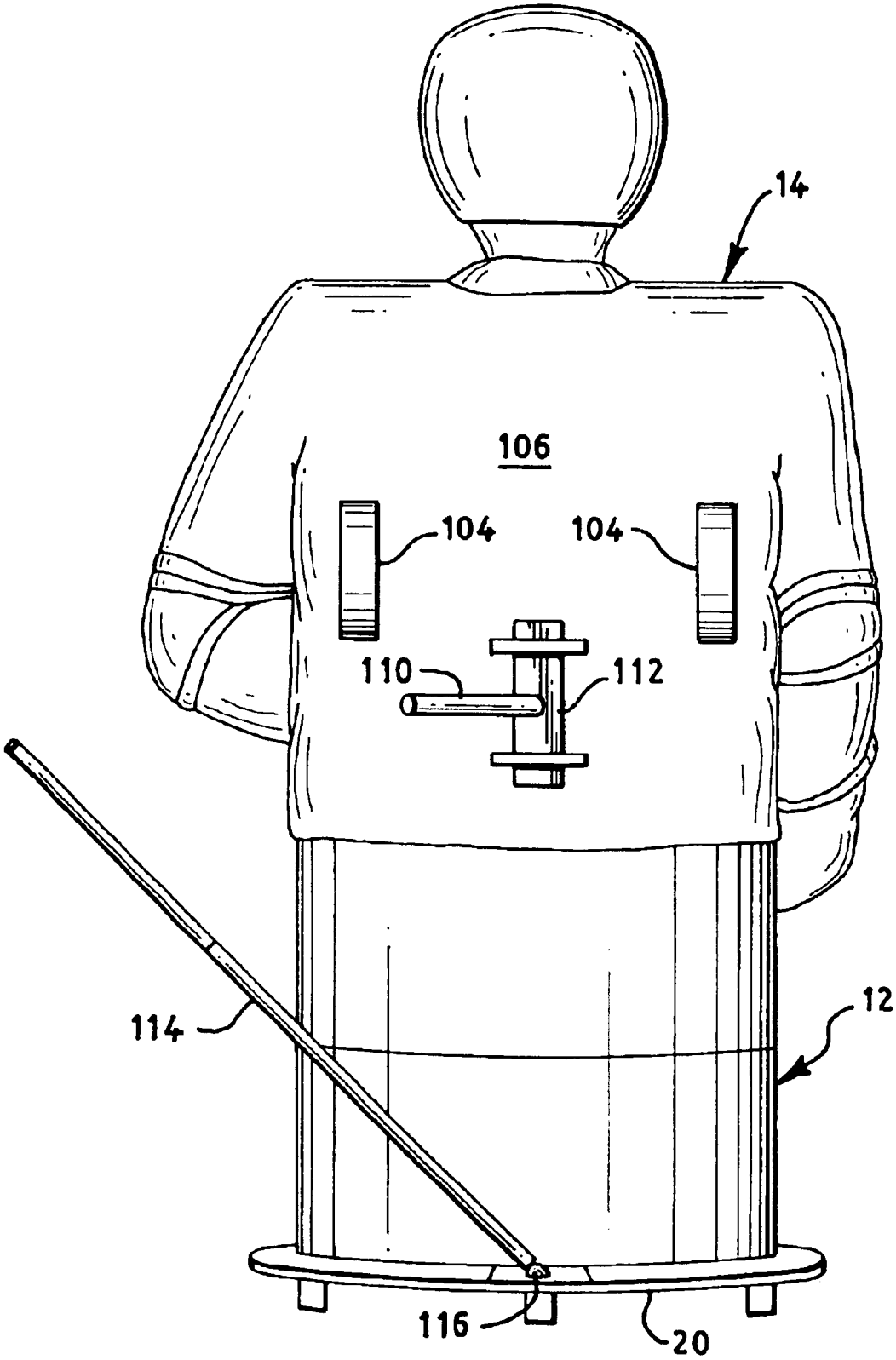
FIG. 7 is a rear view of the body showing various embodiments of the control grip.

The other mobility component is the control grip 102. Several types, shown in FIG. 7, are contemplated for use by the present invention. The simplest is a pair of hand loops 104 attached to the back 106 of the upper body 14 in places that are convenient. The attachment must be robust enough to handle the shock of the dummy 10 being hit repeatedly. These dual loops provide a means to closely control the motion of the dummy 10, but they take two hands and the dummy 10 is relatively close to the operator, so the chance of operator injury is relatively high.

A second control grip 102 is a rigid bar 110 extending rearwardly from the back of the upper body 14 and mounted to pivot from side to side, as at 112. There are a number of methods known in the art to provide a pivoting attachment. Examples include the axle rotating in bearings, as shown in FIG. 7, a ball joint, and a double sided hinge. Any method that provides a pivoting attachment that is robust enough to absorb the shock of repeated hits to the dummy 10 may be employed.

Another control grip 102 is an elongated rod 114, such as a broom handle, attached to the foundation 20 by a ball and socket joint 116. As with the above-described control grips, the ball and socket joint must be robust enough to absorb the shock of repeated hits to the dummy 10.

Optionally, the control grip 102 is removable for storage or to lash the dummy 10 to a stationary object, such as rink boards. The later facilitates practicing checking against the boards.

Thus it has been shown and described a hockey checking practice dummy which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

I claim:

1. A dummy for use in practicing hockey checking comprising:

(a) a generally cylindrical base including a rigid foundation and a rigid, upwardly-extending column, said foundation having an undersurface adapted to glide on a playing surface;

(b) an upper body designed with the general proportions of the upper body of a human being said upper body including a back, a torso, a head, arms, shoulder pads, a jersey, a helmet and a rigid column extending downwardly from said torso, said base column and said upper body column being slidably connected; and (c) a control grip attached to said back that provides a grip secure enough for a coach to control the motion of said dummy on said playing surface while being hit during said checking.

2. The dummy of claim 1 wherein said base is weighted.

3. The dummy of claim 2 wherein said base includes a hollow container and said weight is obtained from a material poured into said container, said material being removable from said container.

4. The dummy of claim 1 wherein said base includes a puck holder that retains a puck on said playing surface.

5. The dummy of claim 1 wherein said foundation is covered in padding.

6. The dummy of claim 1 wherein said control grip includes a pair of loop handles attached to said back of said upper body.

7. The dummy of claim 1 wherein said control grip includes a handle pivotally attached to said back of said upper body.

8. The dummy of claim 1 wherein said foundation undersurface is composed of or coated with a non-stick material.

9. The dummy of claim 1 wherein said foundation undersurface includes a plurality of wheels.

10. The dummy of claim 1 wherein said foundation undersurface includes a plurality of knobs.

11. The dummy of claim 10 wherein said plurality of knobs are composed of or coated with a non-stick material.

12. The dummy of claim 1 wherein said upper body includes gloves and a hockey stick with a blade, said hockey stick attached to said gloves and arranged such that said blade rests on said playing surface.

13. The dummy of claim 12 wherein said hockey stick is removably attached to said gloves, and said arms and stick are movable such that said dummy can emulate a left handed person or a right handed person.

14. The dummy of claim 1 wherein the height of said dummy is adjustable.

15. The dummy of claim 14 wherein one of said columns includes at least one internal protrusion and the other of said columns includes at least one depression, said at least one depression having a vertical spine and at least one branch at a junction of said spine, a remote end of said branch being lower than said junction, said protrusion residing in said depression, whereby, in order to change said height, said protrusion is moved within said spine into alignment with one of said junctions, said upper body is twisted so that said protrusions moves into said branch and said protrusion is residing in said remote end of said branch.

16. A dummy for use in practicing hockey checking comprising:

(a) a generally cylindrical base including a rigid foundation and a rigid, upwardly-extending column, said foundation being covered in padding and having an undersurface adapted to glide on a playing surface, said base being weighted;

(b) an upper body designed with the general proportions of the upper body of a human being, said upper body including a back, a torso, a head, arms, and a rigid column extending downwardly from said torso, said upper body including shoulder pads, a jersey, a helmet, gloves and a hockey stick with a blade, said hockey stick attached to said gloves and arranged such that said blade rests on said playing surface, said base column and said upper body column being slidably connected in such that the height of said dummy is adjustable; and (c) a control grip whereby a user can control the motion of said dummy on as playing surface.

17. The dummy of claim 16 wherein said base includes a hollow container and said weight is obtained from a material poured into said container, said material being removable from said container.

18. The dummy of claim 16 wherein said base includes a puck holder that retains a puck on said playing surface.

19. The dummy of claim 16 wherein said control grip includes a pair of loop handles attached to said back of said upper body.

20. The dummy of claim 16 wherein said control grip includes a handle pivotally attached to said back of said upper body.

21. The dummy of claim 16 where said control grip includes an elongated handle attached to said foundation by a ball and socket joint.

22. The dummy of claim 16 wherein said foundation undersurface is composed of or coated with a non-stick material.

23. The dummy of claim 16 wherein said foundation undersurface includes a plurality of wheels.

24. The dummy of claim 16 wherein said foundation undersurface includes a plurality of knobs.

25. The dummy of claim 24 wherein said plurality of knobs are composed of or coated with a non-stick material.

26. The dummy of claim 16 wherein said hockey stick is removably attached to said gloves, and said arms and stick are movable such that said dummy can emulate a left handed person or a right handed person.

27. The dummy of claim 16 wherein one of said columns includes at least one internal protrusion and the other of said columns includes at least one depression, said at least one depression having a vertical spine and at least one branch at a junction of said spine, a remote end of said branch being lower than said junction, said protrusion residing in said depression, whereby, in order to change said height, said protrusion is moved within said spine into alignment with one of said junctions, said upper body is twisted so that said protrusions moves into said branch and said protrusion is residing in said remote end of said branch.

* * * * *